United States Patent [19]

Ahlf et al.

[11] Patent Number: 4,685,170

[45] Date of Patent: Aug. 11, 1987

[54] BRISTLE COMPONENT FOR A FLOOR CLEANING NOZZLE

[75] Inventors: Heinz-Jürgen Ahlf, Bergisch-Gladbach; Wieland Gühne, Remscheid; Hans-Peter Simm, Wuppertal; Peter Wulf, Ennepetal, all of Fed. Rep. of Germany

[73] Assignee: Vorwerk & Co. Interholding GmbH, Wuppertal, Fed. Rep. of Germany

[21] Appl. No.: 841,177

[22] Filed: Mar. 19, 1986

[30] Foreign Application Priority Data

Mar. 19, 1985 [DE] Fed. Rep. of Germany ... 8508144[U]

[51] Int. Cl.[4] ..... A47L 9/06

[52] U.S. Cl. ..... 15/367; 15/398; 15/420

[58] Field of Search ..... 15/396, 398, 399, 400, 15/367

[56] References Cited

U.S. PATENT DOCUMENTS

| | | | |
|---|---|---|---|
| 1,094,579 | 4/1914 | Matchette | 15/398 X |
| 2,241,775 | 5/1941 | Forsberg | 15/398 |
| 2,241,776 | 5/1941 | Dahl | 15/398 |
| 2,747,217 | 5/1956 | Stahl | 15/399 X |
| 4,219,902 | 9/1980 | DeMaagd | 15/398 X |

FOREIGN PATENT DOCUMENTS

| | | | |
|---|---|---|---|
| 860549 | 9/1940 | France | 15/398 |

*Primary Examiner*—Chris K. Moore

*Attorney, Agent, or Firm*—Walter Ottesen

[57] ABSTRACT

A bristle component is disclosed for a floor cleaning nozzle for vacuum cleaners. The bristle component includes a bristle holding strip mounted to the housing of the nozzle. The holding strip is provided with downwardly extending bristles at the corners or sides of the housing which are longer than the remaining bristles held therein. These longer bristles extend laterally from the sides of the housing as the nozzle is moved along the floor and sweep away dust from the floor in a corner defined by the floor and a surface extending upwardly from the floor such as the wall of a room or the like.

4 Claims, 2 Drawing Figures

BRISTLE COMPONENT FOR A FLOOR CLEANING NOZZLE

FIELD OF THE INVENTION

The invention relates to a bristle component for floor cleaning nozzles of vacuum cleaners. The bristle component includes a retaining strip with bristles secured therein, and the retaining strip is secured in the housing of the nozzle.

BACKGROUND OF THE INVENTION

Typical floor cleaning nozzles for vacuum cleaners include a plastic housing with a suction opening. The suction opening is surrounded by a bristle strip usually comprising a retaining strip having bristles secured therein. The retaining strip is then secured in the nozzle housing such that it matches the dimensions and shape of a given nozzle. The bristle strip is necessary, first to enable mechanical loosening of lightweight dirt and second to support the nozzle against the floor in such a way that the housing will not scrape along a hard floor surface and leave scratches. For this reason, the bristles of the bristle ring are quite stiff which also enables them to absorb the force exerted upon the nozzle housing during vacuum cleaning.

A disadvantage of this type of floor nozzle is that with it, it is difficult to reach into corners or move close to edges and remove dirt from such areas.

SUMMARY OF THE INVENTION

It is an object of the invention to provide a bristle component that enables cleaning at edges and in corners as well, without impairing the supporting function of the brushes.

This object is attained by providing longer bristles or bunches of bristles, which protrude farther downward than the other bristles, in the corners or sides of the nozzle. With this arrangement, it is also possible to make these bristles or bunches of bristles less stiff than the others.

The invention thus has the advantage that with the floor cleaning nozzle equipped in this way, it is additionally possible to clean edges and corners well without restricting the supporting characteristics of the bristle component as a whole.

BRIEF DESCRIPTION OF THE DRAWING

The invention will now be described with reference to the drawing wherein.

DESCRIPTION OF THE PREFERRED EMBODIMENTS OF THE INVENTION

Figure 1:
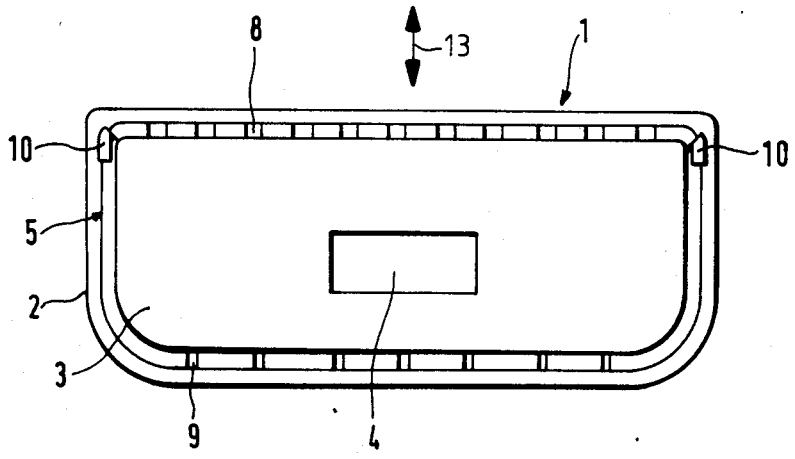
FIG. 1 is a bottom plan view of the floor cleaning nozzle having a bristle component according to the invention; and, FIG. 2 is a front elevation view of the floor cleaning nozzle of FIG. 1.
Figure 2:
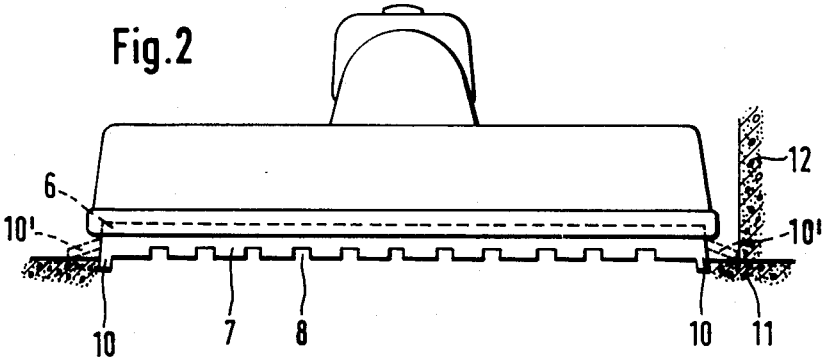

FIG. 1 shows a floor cleaning nozzle 1 from below. This nozzle includes a nozzle housing 2, closed off at the bottom by a bottom plate 3. In the bottom plate 3, there is an opening 4 through which an attached vacuum cleaner (not shown) draws up the dirt by suction. A bristle component 5, surrounding the bottom plate 3 on all sides, is also mounted in the nozzle housing 2. The bristle component 5 comprises a retaining strip 6, which is secured in the nozzle housing 2 (see FIG. 2), and bristles or bunches of bristles 7, which are secured in the retaining strip 6. When viewed in the direction in which the floor cleaning nozzle is used (as indicated by arrow 13), the bristles or bunches of bristles 7 are seen to have openings 8, 9 at the front and back of the nozzle housing 2.

The retaining strip 6 is provided with longer bristles or bunches of bristles 10, which protrude downwardly; in the embodiment shown here, these are disposed in the front corner areas of the nozzle housing 2. These bristles 10 are embodied somewhat like an artist's paintbrush, and they also function in a like manner. In other words, when a load is placed on the nozzle housing 2, as is always the case when the nozzle is being used, the mere force exerted in pushing the nozzle bends the longer bristles 10, which are also less stiff than the other bristles, into the position 10' on the floor surface 11. As a result, they no longer act as a support, bearing a load on their tips, but instead protrude out from the nozzle toward a wall 12 of a room or the like, where they can, in the manner of a paintbrush, exert a sweeping action, so that it is possible to sweep dirt out of the corner that is conjointly defined by the wall and the floor.

It is understood that the foregoing description is that of the preferred embodiments of the invention and that various changes and modifications may be made thereto without departing from the spirit and scope of the invention as defined in the appended claims.

What is claimed is:

1. A floor cleaning nozzle for attachment to vacuum generating means and adapted for movement over the floor in a predetermined direction such as next to a surface extending upwardly from the floor, the floor and the surface conjointly defining a corner wherein dust and the like can accumulate, the floor cleaning nozzle comprising:

a housing through which dust and the like is drawn from the floor by said vacuum generating means; said housing having a substantially quadrilateral peripheral edge facing toward the floor; and, a bristle component for supporting the housing on the floor as it is moved therealong, said bristle component including:

a single bristle holding strip attached to said housing about the periphery thereof and having segments at the forward corners of said peripheral edge;

a plurality of downwardly extending first bristles tightly held by said holding strip along the length thereof for supporting said housing on the floor; and, a plurality of second bristles extending downwardly substantially parallel to the adjacent ones of said first bristles also tightly held by said holding strip at only said segments and extending downwardly from said housing farther than said first bristles thereby permitting said second bristles to be bent by contact with the floor and extend outwardly from said housing transversely to said predetermined direction and into said corner to dislodge and sweep away said dust disposed therein when the nozzle is moved over the floor next to said surface.

2. The floor cleaning nozzle of claim 1 said second bristles having a stiffness less than said first bristles.

3. A floor cleaning nozzle for attachment to vacuum generating means and adapted for movement over the floor in a predetermined direction such as next to a surface extending upwardly from the floor, the floor and the surface conjointly defining a corner wherein dust and the like can accumulate, the floor cleaning nozzle comprising:

a housing through which dust and the like is drawn from the floor by said vacuum generating means; said housing having a substantially quadrilateral peripheral edge facing toward the floor; and, a bristle component for supporting the housing on the floor as it is moved therealong, said bristle component including:

a single bristle holding strip attached to said housing about the periphery thereof and having segments at the forward corners of said peripheral edge;

a plurality of downwardly extending first bristles tightly held by said holding strip along the length thereof for supporting said housing on the floor; and, a plurality of second bristles extending downwardly substantially parallel to the adjacent ones of said first bristles also tightly held by said holding strip at said segments and extending downwardly from said housing farther than said first bristles thereby permitting said second bristles to be bent by contact with the floor and extend outwardly from said housing transversely to said predetermined direction and into said corner to dislodge and sweep away said dust disposed therein when the nozzle is moved over the floor next to said surface.

4. The floor cleaning nozzle of claim 3, said second bristles having a stiffness less than said first bristles.

* * * * *